United States Patent [19]

Arend et al.

[11] 4,208,972

[45] Jun. 24, 1980

[54] SELF-SERVING MULTI-TIERED COUNTER DISPLAY STAND

[75] Inventors: Raymond J. Arend; John A. VerBerkmoes, both of Grand Haven, Mich.

[73] Assignee: Bastian Blessing Co. Inc., Phoenix, Ariz.

[21] Appl. No.: 882,803

[22] Filed: Mar. 2, 1978

[51] Int. Cl.[2] ..... A47B 3/00

[52] U.S. Cl. ..... 108/111; 108/111; 312/137; 312/140.1

[58] Field of Search ..... 108/23, 27, 92, 101, 108/111; 312/137, 140.1–140.3, 223, 140; 186/1 R

[56] References Cited

U.S. PATENT DOCUMENTS

| | | | |
|---|---|---|---|
| 1,706,345 | 3/1929 | Bleakley | 212/140.3 X |
| 1,744,081 | 1/1930 | Reid | 312/140 |
| 2,702,223 | 2/1955 | Mucher | 312/140.1 X |
| 2,848,119 | 8/1958 | Fitser | 108/101 |
| 2,894,604 | 7/1959 | McMillan | 312/140.1 X |
| 3,026,162 | 3/1962 | Waszkiewicz | 312/140.4 |
| 3,275,371 | 9/1968 | Rowland | 297/445 X |
| 3,437,057 | 4/1969 | Wulff | 108/22 |
| 3,847,250 | 11/1974 | Sherrill | 312/140.4 X |
| 4,013,880 | 3/1977 | Kennedy et al. | 312/223 X |

*Primary Examiner*—James C. Mitchell

*Attorney, Agent, or Firm*—Sixbey, Friedman & Leedom

[57] ABSTRACT

An easily and readily cleaned, preferably multi-tiered, freely movable, counter-top food display stand for self service which is simple in construction, easy to assemble and maintain and provides full viewability, maximizes accessibility and shields for sanitation the food displayed. The stand is preferably supported at each tier, in whole or a major part, by one leg at each end with the leg of the lowest tier disposed at the front where customer contact might occur and damage be resisted.

9 Claims, 17 Drawing Figures

22R
26
58
24
28
56
28E
22F
64
62
20
30A
32
66
44H
44B
24B
30
38H
30G
30R
44F
34
36
38U
38
46
48
44U
40
20E
50

SELF-SERVING MULTI-TIERED COUNTER DISPLAY STAND

BACKGROUND OF THE INVENTION

For the convenient, inexpensive and rapid self-service of food to the public under open room conditions there are many critical considerations involved including protecting food against contamination yet providing full selectivity and quick accessibility.

Conventional sliding or pivoted access doors with windows provide some environmental protection for food displayed under room conditions but slows the movement of patrons if kept closed as they should be between servings.

Spring or gravity closed sliding or pivoted access doors with windows provide some environmental protection for the food displayed but slows the progress of patrons and increases spillage and clean-up requirements caused by collisions with the moving closures. Wide open spaces above or in front of a shelf for access to the food permits foreign particles in the circulating air to contaminate the food while any protective positive air movement provided to prevent this dries the food and may interfere with shelf replenishment.

SUMMARY OF THE INVENTION

In the present invention easily fabricated spaced unitary support frames of unique design carry horizontally disposed transparent shelves, preferably plastic which can be easily wiped clean and serviced through a wide open rear side while access and removal of the food at the front side is confined to a vertically narrow horizontal opening at the level of the shelf but below a downwardly and outwardly inclined sanitation apron which affords ready access for self service but serves as a sneeze and dust guard against both food contamination, and manual contact except for removal.

The display can be several shelves high to provide a good survey of like items for quick comparison and selection in a fully viewable space as well as being protected healthwise against customer breathing, sneezing and coughing.

The structure also enables the highly desirable full use of readily cleanable transparent walls and pleasing framework of unitized decorative polished chrome to invite and suggest cleanliness.

IN THE DRAWINGS

DESCRIPTION OF THE INVENTION

Figure 9:
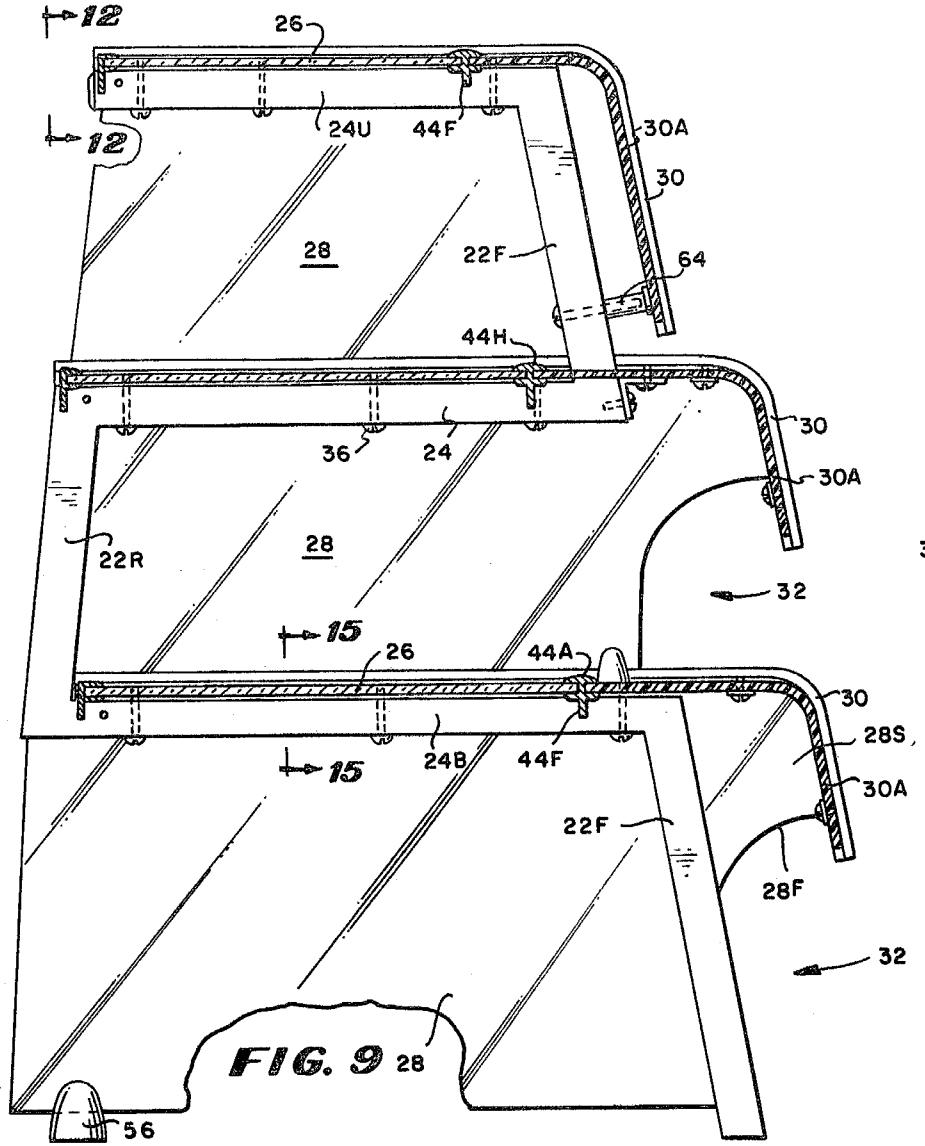
FIG. 9 is a cross-section illustrating the structure of an end bracket taken on line 9—9 in FIG. 4.
Figure 12:
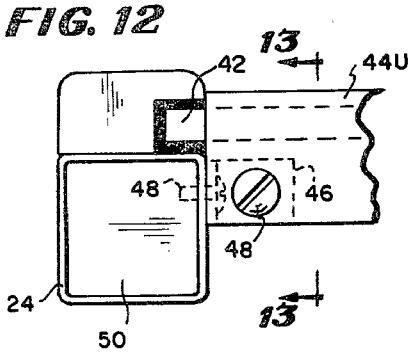
FIG. 12 is a rear view taken upon line 12—12 in FIG. 9.

Referring now to the drawings in further detail the support frames 20 are preferably integrally formed as selectively shaped frames of square tubes cut and joined at each corner by welding to provide the complementary angles between zig zag vertical and horizontal portion 22 and 24, respectively, integrated to support transparent glass or plastic shelves 26, windows 28 and dust guards 30. Preferably the front vertical portions 22F of the frames are designed to incline 10° away from the customer (FIG. 9) when erected and those 22R at the rear, which may be located on the kitchen side, are preferably inclined in the opposite direction 5° to assist visual inspection at the front.

The front inclination invites self-serving patrons to take a closer look subconsciously from above the level of the shelf or shelves 26 so that the front access openings 32 (FIG. 9) at the shelf level are well below the expectorant path of customer sneezes etc., which can be blocked or deflected outwardly by the downwardly and outwardly inclined transparent guard aprons 30 that shield and deflect outwardly any air having a downward component of movement.

Figures 6, 7, 8:
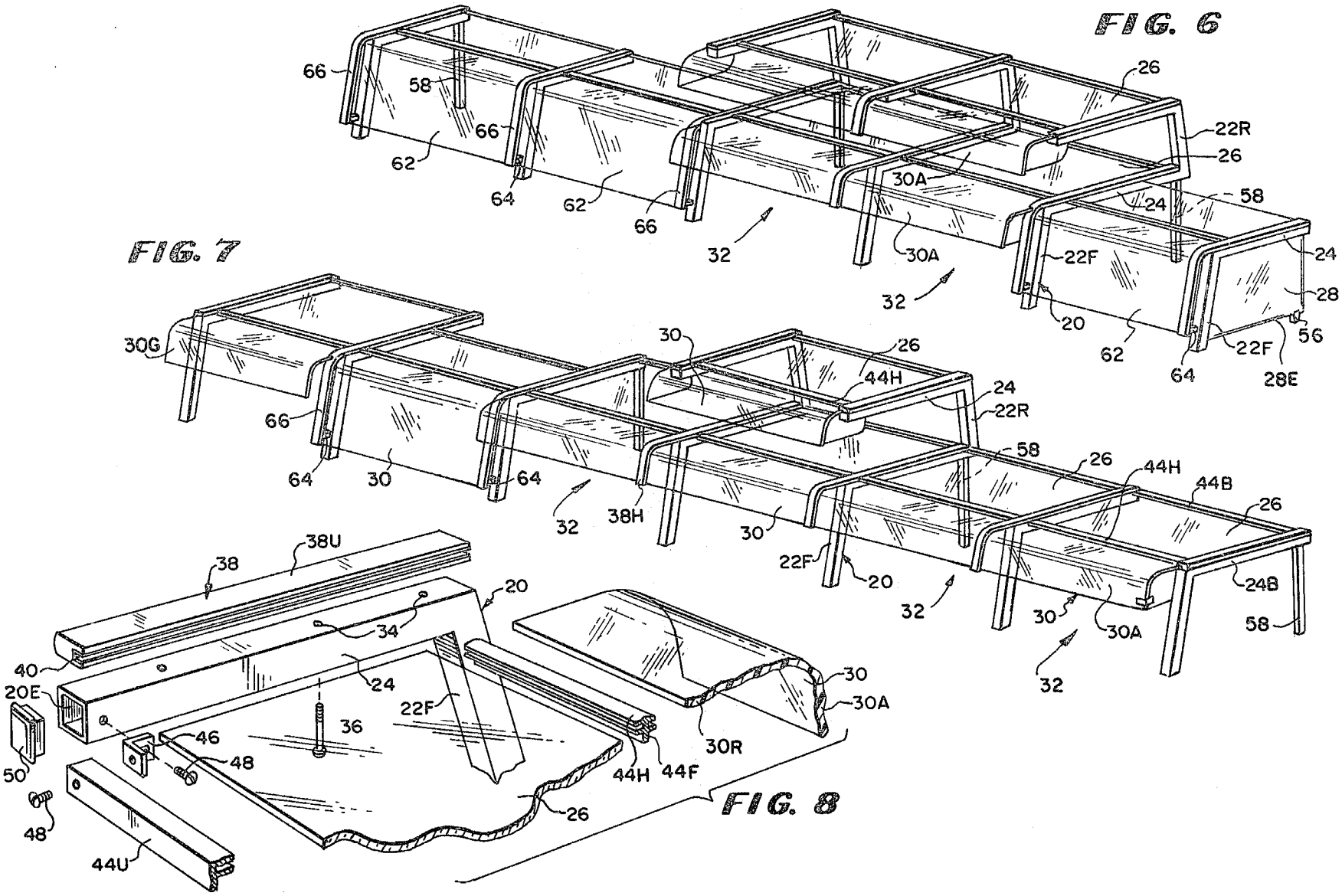
FIGS. 6 and 7 are perspective views of other composite shelf arrangements involving portable structure FIGS. 1 to 5.
FIG. 8 is an exploded view of the top portions of the end bracket of FIG. 5.
Figure 15:
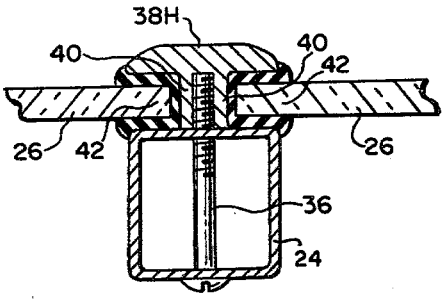
FIG. 15 is a sectional view taken upon line 15—15 in FIG. 9.

The drawings illustrate various forms, heights and volumes of shelving which are available and the desired results attainable with the invention for the above purposes including the ready access and removal of food dishes from the shelves 26. They illustrate the horizontal portions 24 as shown in FIG. 8 which have vertically spaced openings 34 receiving screws 36 which secure a molding 38, such as a U-molding 38U (FIG. 17) having a horizontally directed groove 40 or an H molding 38H (FIG. 15) having two oppositely directed horizontal grooves 40. When the moldings 38 are in place the grooves 40 receive in semi-clamping supported relation the end edges 42 of the shelves 26, and, between adjacent frames 20, the frames and moldings 38 are tied by longitudinal U-shaped, strips 44U along the back sides of the shelves which receive and support the rear edges of the shelves, and H-shaped strips 44H (FIG. 16) receiving and supporting the front edges of the shelves 26. The front grooves of strips 44H receive the rear edge 30R of plexiglass shelf portions 30 that are rounded downwardly by molding beyond the front legs 22F into forwardly inclined apron portions 30A which serve as sneeze deflector guards 30A.

The frames 20 are spaced and held together at their horizontal sections by the U and H section strips 44U and 44H supported by angle members 46 secured by screws 48 as illustrated in FIG. 8, with the square open ends 20E of the brackets 20 closed by decorative plastic caps 50.

Figure 11:
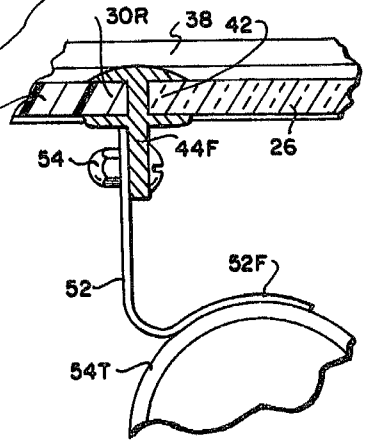
FIG. 11 is a sectional view taken on line 11—11 in FIG. 10.
Figure 14:
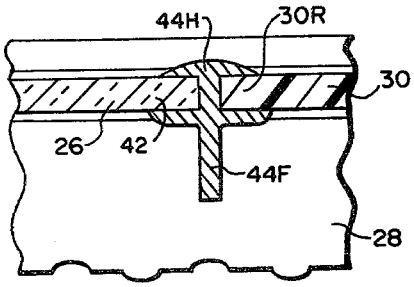
FIG. 14 is a sectional view of a dual throat molding assembly in FIG. 9.
Figure 16:
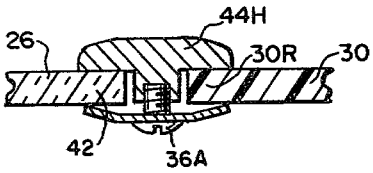
FIG. 16 is a modification of the embodiment shown in FIG. 14.
Figure 17:
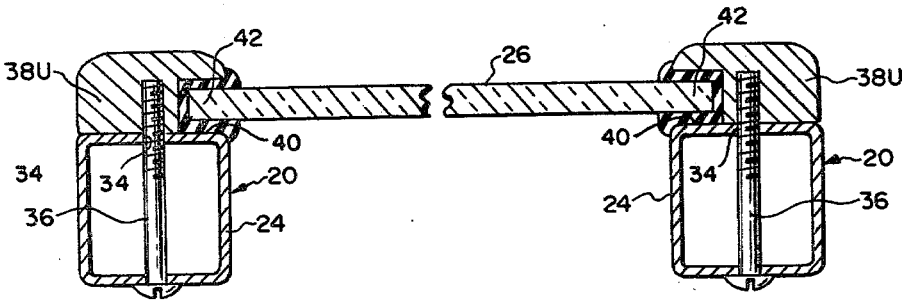
FIG. 17 is a sectional view of the cross bracket detail taken on line 17—17 in FIG. 5.

As illustrated in FIGS. 14 and 16 the joint at strip 44H between the glass shelf 26 and plastic guard 30A is preferably located well within the confines of the frame 20 and the strip 44H securing them is provided with a depending flange 44F (FIGS. 11 and 14) to which a fluorescent lamp fixture 52, including a reflector 52F, is secured by bolts 54 where fluorescent tubes 54T are accessible for replacement from either the front or back of the shelves 26.

Figure 1:
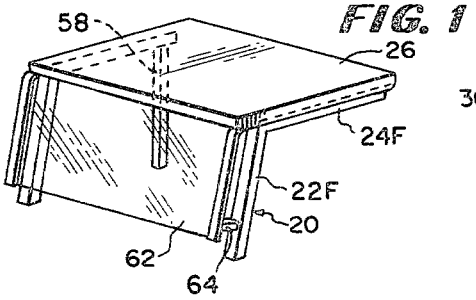
FIGS. 1 and 2 are perspective views of single height embodiments in one and two section lengths.
Figure 2:
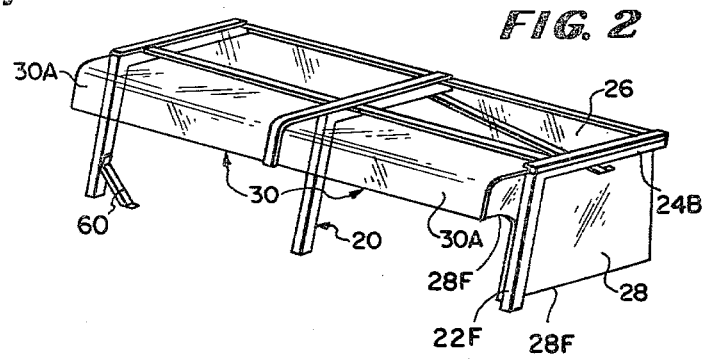
Figure 3:
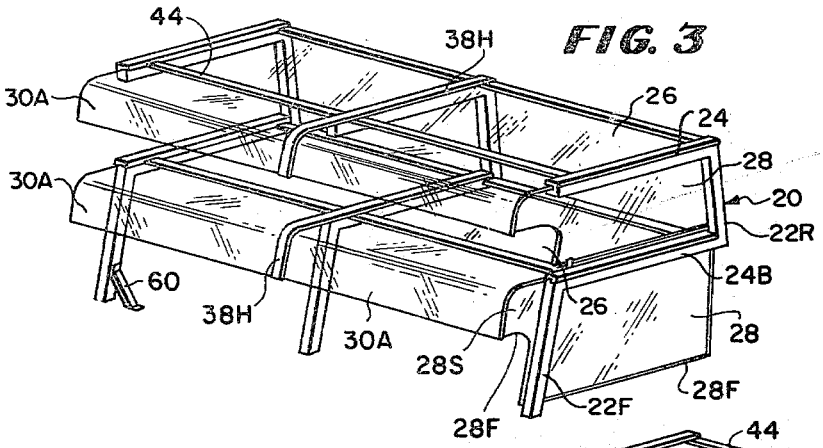
FIGS. 3 and 4 are perspective views of dual section lengths that are two and three shelves high respectively.
Figure 4:
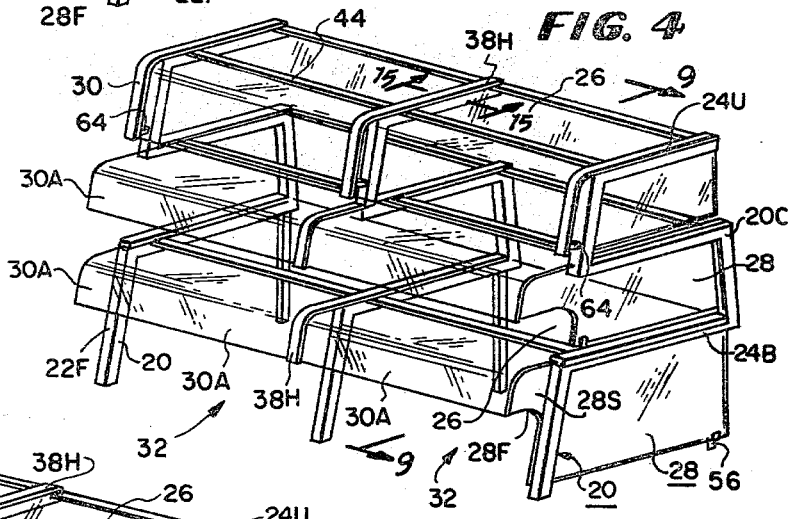
Figure 5:
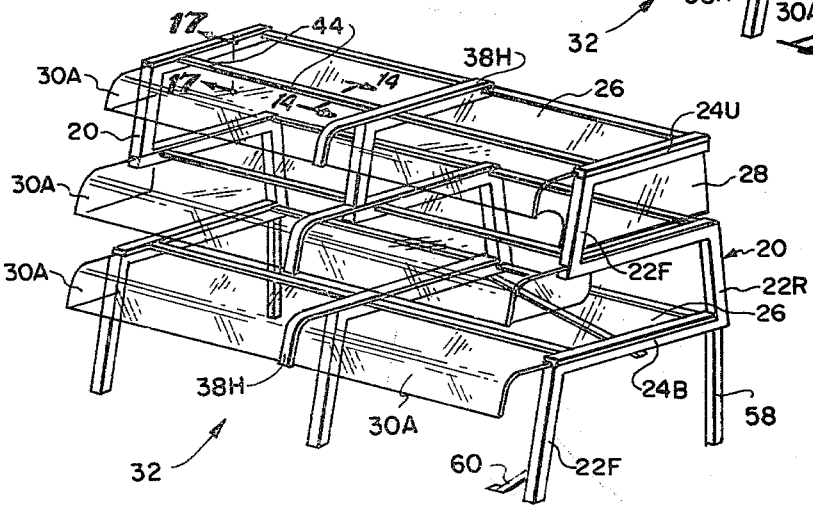
FIG. 5 is a perspective view of a three tier dual section length.
Figure 10:
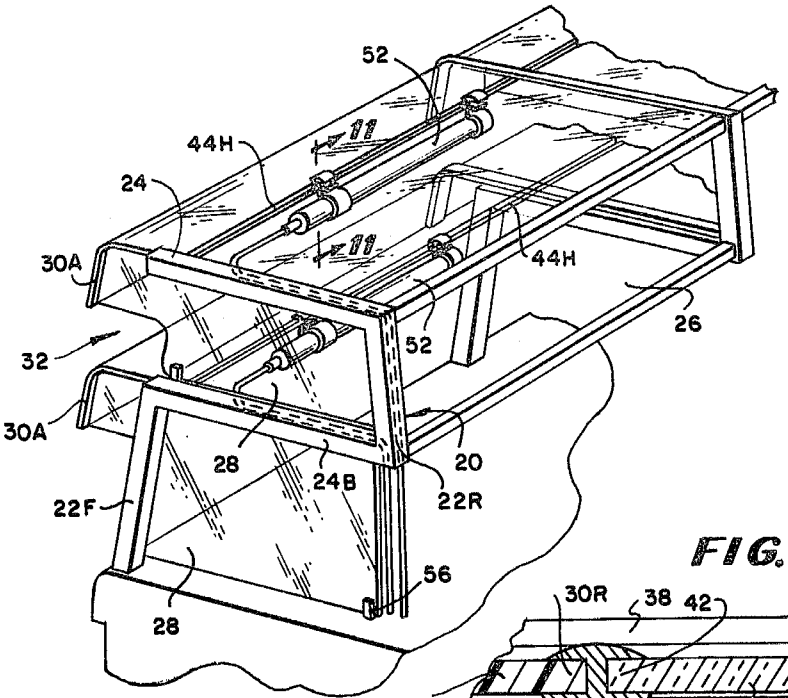
FIG. 10 is a perspective end view of an embodiment with an end glass and fluorescent light.

Not only do the downwardly inclined guards 30A shield the displayed food on the shevles 26 and define the opening 32 through which food may be taken, but they being fastened at 64 rigidify the frame 20 of the display stand against lateral sway through the bind of the strips 38U and 38H (FIGS. 15 and 17) thereby making it possible for the stand to be set on a table or cabinet top, in which relation as illustrated in FIGS. 2–4 the lowest edge 28E of the window panels 28 serves edgewise as a rear leg support, preferably supported either in a U-shaped resilient foot 56 (FIGS. 4, 6 and 10) or, without the window panel 28 being present, by a rear leg 58 (FIG. 5) secured by an L-bracket 60 as squared against the bottom of the lowest horizontal arm of the frame 20 as illustrated in FIGS. 2, 3, 5 or fastenings 64 (FIG. 7).

Figure 13:
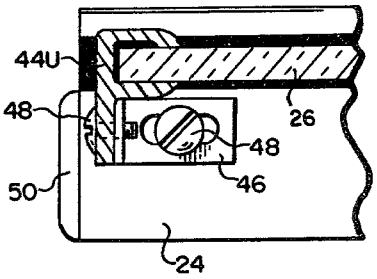
FIG. 13 is a sectional view taken upon line 13—13 of FIG. 12.

Each tubular frame 20 can be made of separate tubular members with the ends of vertical members 22F butt-welded in jigs against the ends of the horizontal sections 24 and with exposed open ends capped by plastic caps 50, (FIG. 13) or, each pair of members 22 and 24 forming a corner mitered at complementary angles as desired with the cut edges then conventionally seam welded and polished. All shelves are preferably open at the rear and are progressively offset inwardly towards the top to provide easier reach for persons using the self serving equipment.

As shown in FIGS. 1–7 the elements may be assembled in a selection of separate parts as unitized units including an interchangeable sneeze guard 30A (FIG. 6) and a full protection guard 62 where selected food items are displayed but freshly made up dishes are handed to the patrons by an attendant. The guard 62 (FIG. 6) is interchangeable with the sneeze guard 30A by removal of the sneeze guard 30A and the installation of the protector guard 62 with spacer bolts 64 and a cap strip 66. The protection guard is secured and supported at all edges against access, and the front spacers 64 are interchangeable for reasonable lengths depending upon the position desired for the lower front edge thereof.

Furthermore, it will be observed that the plastic sides 28 at the ends may be shaped (FIGS. 2, 3 and 4) at their front edges 28F to provide side closure extensions 28S of any shape desired to support and serve as a part of the sneeze guard 30A at the end wall or walls covering the end spaces between the shelves. Otherwise the shape of the guard 30 can be varied as desired to fit various conditions including a partial cut away to clear tall glasses or other shapes that are employed for either utilitarian purposes or style.

What is claimed is:

1. A rigidly constructed self-service multi-tier food display and dispensing stand for resting movably on a flat top supporting surface, each tier including two inverted L-shaped frame members collectively defining in part a plurality of pairs of integrated horizontally spaced parallel horizontal arms and horizontally spaced vertically disposed legs in which the top end of each leg is terminally secured rigidly to one end of a horizontal arm and the arms in a lower tier are rigidly secured at their other ends to the lowest ends of the legs of the tier above it, said legs at the front defining a front access opening through the space between them above the flat top supporting surface of the display stand and the rear legs defining a rear access opening through the space between them and the vertically spaced horizontal arms, means carried by the lower frame member for supporting its arms in horizontal position, strip means interconnecting the frame members for holding them in spaced and erect relation, transparent horizontally disposed shelf means rigidly carried normal to and supported on the horizontal arms, defining storage spaces that are visible through and below them for storing and displaying food resting on said shelf means and flat top and being horizontally available for self-service between the front legs, and transparent extension means supported on each pair of said horizontal arms co-planar with said shelf means and extending horizontally above and overhanging said access opening and extending forwardly and downwardly beyond said front legs a substantial distance substantially parallel with the legs in front of said opening at an inclination horizontally closing at least a major portion of the upper half of said access opening to protect vertically and horizontally the food in said space from sneezes of self-serving patrons while providing adequate but limited opening areas for removal of food bearing dishes slid from said storage space.

2. The combination of claim 1 in which said transparent extension means extends horizontally outwardly in a downwardly terminally inclined direction a sufficient distance to cover a major portion of the top of said opening for close visual inspection and to obstruct removal of any dished food through said opening.

3. The combination defined in claim 1 in which the spaced legs are integrally formed with the horizontal arm portions supporting said shelf with rigid securement thereto to provide an integrated self-serving shelf on top thereof and including transparent side window means successively supporting said horizontal arm portions vertically in weight bearing relation and defining in part said visible storage space.

4. The combination defined in claim 1 in which said carried means includes vertical side shield means extending from said legs to said transparent extension means.

5. The combination defined in claim 3 including vertically disposed rear inverted L-shaped leg portions coplanar with said vertical and horizontal portions and rigidly secured in supported relation upon the rear ends of said horizontal portions, a second transparent horizontally disposed shelf supported on the horizontal portions of the second legs at the rear of said horizontal supports and defining with the first shelf an access opening between them at the front of said stand, and a second transparent extension means inclined outwardly to overhang said shelf and extending downwardly to a level obstructing at least a major portion of the upper half of the last said opening.

6. The combination defined in claim 1 including a strip means defining oppositely opening grooves disposed horizontally and receiving in supported relation the adjacent coplanar edges of said transparent extension means and shelf and including a depending flange means, and means for supporting a depending fluorescent light thereon inwardly of said opening.

7. The combination defined in claim 1 including molding elements in combination with said horizontal arms defining opposing horizontal grooves receiving the end edges of said horizontally disposed transparent shelf members in supported relation and including strips means between said horizontal arms securing the horizontal arms in spaced relation.

8. The combination defined in claim 1 in which the inverted L-shaped members include integral bracket sections with the leg portion of one rigidly engaging in supported relation the end of the arm of another leg portion below it to provide zig-zag frames.

9. The combination defined in claim 1 in which the leg portions are inclined from the vertical at an obtuse angle with respect to each other.

* * * * *